US007649171B1

(12) United States Patent
Freidhoff

(10) Patent No.: US 7,649,171 B1
(45) Date of Patent: Jan. 19, 2010

(54) MINIATURE MASS SPECTROMETER FOR THE ANALYSIS OF BIOLOGICAL SMALL MOLECULES

(75) Inventor: Carl B. Freidhoff, New Freedom, PA (US)

(73) Assignee: Northrop Grumman Corporation, Los Angeles, CA (US)

( * ) Notice: Subject to any disclaimer, the term of this patent is extended or adjusted under 35 U.S.C. 154(b) by 260 days.

(21) Appl. No.: 11/802,183

(22) Filed: May 21, 2007

(51) Int. Cl.
*H01J 49/26* (2006.01)

(52) U.S. Cl. ..... 250/281; 250/282; 250/288; 250/299

(58) Field of Classification Search ..... 250/281, 250/282, 288, 289, 287, 290, 293, 294, 299; 438/3, 49, 456
See application file for complete search history.

(56) References Cited

U.S. PATENT DOCUMENTS 5,386,115 A 1/1995 Freidhoff et al.
5,432,343 A * 7/1995 Gulcicek et al. ..... 250/288
5,492,867 A * 2/1996 Kotvas et al. ..... 438/3
5,536,939 A * 7/1996 Freidhoff et al. ..... 250/281
2006/0071665 A1* 4/2006 Blake et al. ..... 324/464
2006/0289746 A1* 12/2006 Raznikov et al. ..... 250/294
2007/0205361 A1* 9/2007 Russ et al. ..... 250/288
2008/0283742 A1* 11/2008 Takeuchi et al. ..... 250/288

* cited by examiner

*Primary Examiner*—Nikita Wells
*Assistant Examiner*—Nicole Ippolito Rausch
(74) *Attorney, Agent, or Firm*—Sean Wooden; Andrews Kurth LLP

(57) ABSTRACT

Analysis of biological small molecules such as toxins, spores or cells is achieved by miniature mass spectrometer apparatus and apparatus attached thereto for vaporizing and ionizing a liquid sample fed into an evacuated vaporization chamber as an electrospray. The mass spectrometer apparatus includes: a collimation chamber, a repeller assembly, an internal ionization chamber, a mass filter and ion separation chamber, a drift space region, and a multi-channel ion detection array so as to permit the collection and analysis of ions formed over a wide mass range simultaneously. The vaporization chamber includes an output port adjacent the input to the collimation chamber so as to maximize the amount of vaporized material being fed into the mass spectrometer apparatus.

17 Claims, 5 Drawing Sheets

MINIATURE MASS SPECTROMETER FOR THE ANALYSIS OF BIOLOGICAL SMALL MOLECULES

CROSS REFERENCE TO RELATED APPLICATION

This invention is related to the invention shown and described in U.S. Ser. No. 11/802,196 (Northrop Grumman Case No. 001283-078) entitled "Miniature Mass Spectrometer For The Analysis Of Chemical And Biological Solid Samples" filed in the name of Carl B. Freidhoff, the present inventor, on May 21, 2007.

This invention is also related to the invention shown and described in U.S. Ser. No. 11/260,106 (Northrop Grumman case No. 000810-078) entitled "A MEMs Mass Spectrometer", filed in the name of Carl B. Freidhoff, on Oct. 28, 2005.

The teachings of the above cross-referenced patent applications are intended to be incorporated herein by reference for any and all purposes.

BACKGROUND OF THE INVENTION

1. Field of the Invention

This invention relates to solid state miniature mass spectrometers, and more particularly to a miniature mass spectrometer test system for the analysis of biological small molecules such as toxins, spores or cells by a nanoelectrospray fed into a vacuum.

2. Description of Related Art

A mass spectrometer is a device that permits rapid analysis of an unknown sample of material to be analyzed. A small amount of the sample is introduced into the mass spectrometer where it is ionized, focused and accelerated by means of magnetic and/or electric fields toward a detector array. Different ionized constituents of the sample travel along different paths to the detector array in accordance with their mass to charge ratios. The outputs from the individual detector elements of the array provide an indication of the sample's constituents.

Industrial mass spectrometers are generally large, heavy and expensive, and therefore, a need exists for a miniature, relatively inexpensive light-weight solid state mass spectrometer for use by the military, homeland security personnel, hazmat crews, industrial concerns and the like to test for the presence of dangerous substances in the immediate environment.

A typical miniature mass spectrometer is shown and described in the present assignee's U.S. Pat. No. 5,386,115 entitled "Solid State Micro-Machined Mass Spectrograph Universal Gas Detection Sensor", issued to Carl B. Freidhoff et al. on Jan. 31, 1995. Basically such a device is comprised of two semiconductors substrates joined together by an epoxy seal. Each half includes intricate cavities formed by a lithograph process. Although the device meets the requirements for small size, due to the depth and intricacy of the cavities, the lithographic process is extremely expensive. Further, under vacuum conditions, the epoxy seal tends to add gas into the device thus contaminating the readings obtained and thereby limiting its sensitivity.

In the above-referenced U.S. application Ser. No. 11/260,106, entitled "A MEMs Mass Spectrometer", there is disclosed an improved MEMs mass spectrometer for analyzing a gas sample.

SUMMARY OF THE INVENTION

The present invention is directed to the analysis of biological small molecules by a device consisting of a miniature mass spectrometer test system which is adapted to operate with a minimum of support equipment and includes a nanoelectrospray of a test sample into a vacuum ionizing chamber. The vacuum ionizing chamber is affixed to the front end of the mass spectrometer apparatus and vaporizes a fluid i.e. liquid sample into an atomized spray without heat and drying gas. The vacuum environment comprises an external electrospray-ionization chamber and provides a nanospray fluid flow rate, which is adapted to provide a sufficient number of ions for detection without requiring a large pump or power expenditure. The mass spectrometer includes a differentially pumped front end, which allows the mass spectrometer to sample a higher pressure regime and analyze ions formed at a lower pressure.

In a preferred aspect of the present invention there is provided a mass imaging spectrometer test system for analyzing biological small molecules of a liquid sample, comprising: an evacuated liquid sample input chamber including apparatus for vaporizing and ionizing a liquid sample being fed into the chamber; mass spectrometer apparatus connected to the input chamber and having an ionized vapor input port for receiving ionized vapor of the liquid sample from the input chamber, and wherein the spectrometer includes: a collimation chamber having a vapor collimation sub-assembly connected to the input port and having at least one vacuum pumping aperture for evacuating and drawing said ionized vapor from the evacuated chamber into the collimation chamber; a repeller member located adjacent the vapor collimation sub-assembly; an ionizer sub-assembly located adjacent the repeller member for further ionizing the ionized vapor; an ion optics chamber located adjacent the ionizer sub-assembly; at least one evacuated ion filter and separation chamber located adjacent the ion optics chamber and including means for generating an electromagnetic field therein for separating ions therein by their respective mass/charge ratio; and, a detector array for detecting ions separated in the mass filter and ion separation chamber and located a predetermined distance therefrom by an intermediate drift space region.

Further scope of applicability of the present invention will become apparent from the detailed description provided below. It should be understood, however, that the detailed description and the specific example, while indicating the preferred embodiment of the invention is provided by way of illustration only, since changes and modifications coming within this scope the spirit of the invention will become apparent to those skilled in the art from this detailed description.

BRIEF DESCRIPTION OF THE DRAWINGS

The present invention will become more fully understood from the detailed description provided hereinafter and the accompanying drawings which are provided by way of illustration only, and thus are not meant to be considered in a limiting sense, and wherein.

DESCRIPTION OF THE PREFERRED EMBODIMENTS

Figure 1:
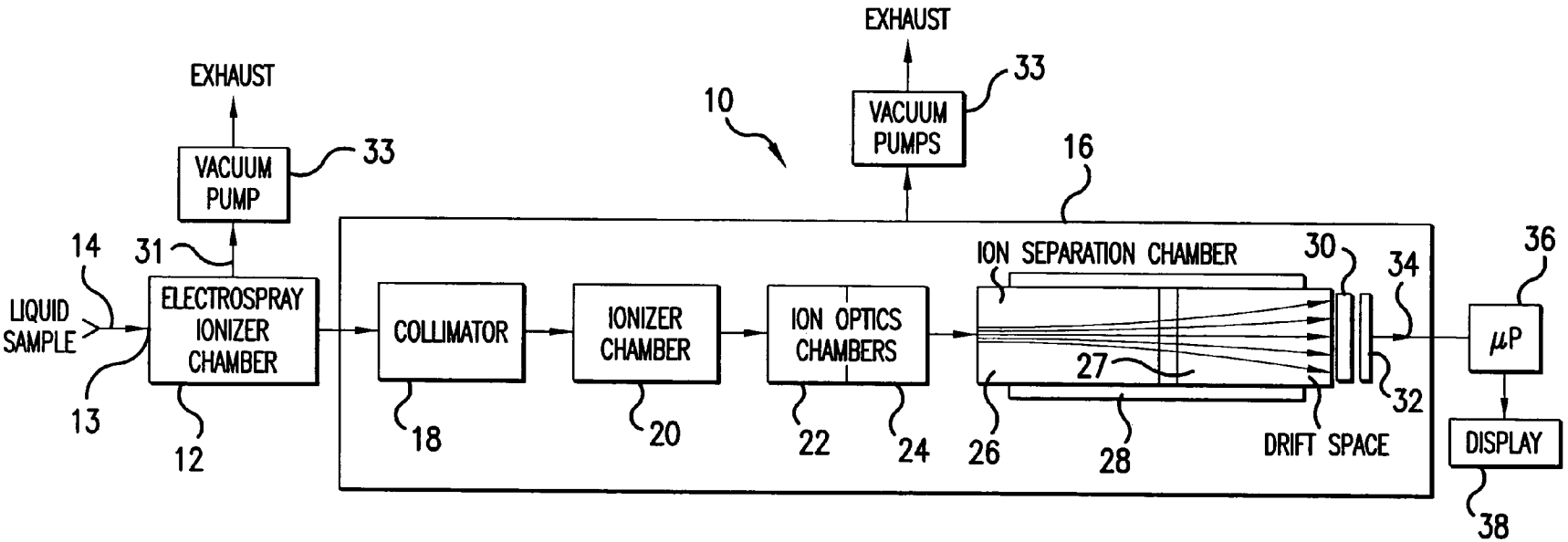
FIG. 1 is a block diagram broadly illustrative of the preferred embodiment of the subject invention.

Referring now to the drawing figures wherein like reference characters refer to like parts, the block diagram of FIG. 1 is illustrative of miniature mass spectrometer apparatus 10 for the analysis of biological small molecules by nanoelectrospray into a vacuum by means of a device fabricated on a chip. Reference numeral 12 denotes an electrospray-ionizer input chamber located in a separate housing 14 (FIG. 2) which is physically attached to a semiconductor chip 16 and in which is located a collimator section 18, an ionizer chamber 20, first and a second ion optics chambers 22 and 24, an ion separation chamber 26, field generating means 28 for generating an electromagnetic field in the ion separation chamber 26 and draft space region 27, an array 30 of detector elements and a readout chip 32. Further, as shown in FIG. 1, a pair of vacuum pumps 33 are connected to the electrospray ionizer chamber 12 and the mass spectrometer chip 16 for separately evacuating the two elements.

Electrospray of a liquid input sample is performed at reduced pressure (vacuum) in the subject invention so as to dissolve large molecules of biological materials such as toxins, spores or cells. Electrospray allows multiple charges to be placed on large biological molecules so as to bring down the effective mass of the ion and with antibody capture or other clean-up techniques to remove background clutter. Thus, the small mass spectrometer of the subject invention is used to sense and separate out different toxins.

Considering now the invention in greater detail, ions produced in the electrospray-ionizer chamber 12 are fed into the collimator 18 which is differentially pumped by a pumping arrangement shown in FIG. 4, described hereinafter, so as to sample a higher pressure regime and analyze ions formed at a lower pressure inside of the electrospray chamber 12. The vacuum environment acts to dry the fluid in the atomized spray without heat and drying gas.

Figure 2:
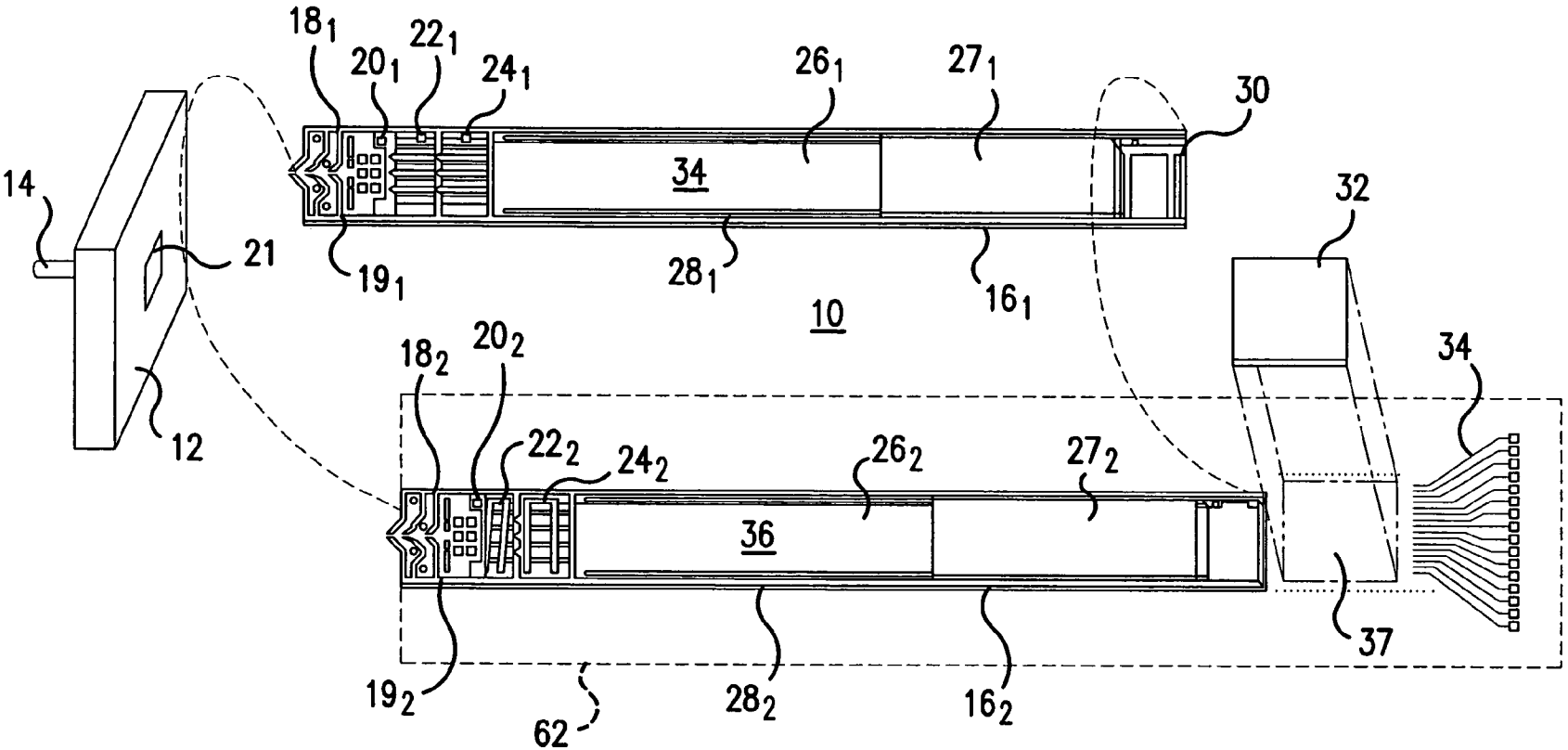
FIG. 2 is an exploded view of two halves of the preferred embodiment of the subject invention including an electrospray ionizer chamber.
Figure 3:
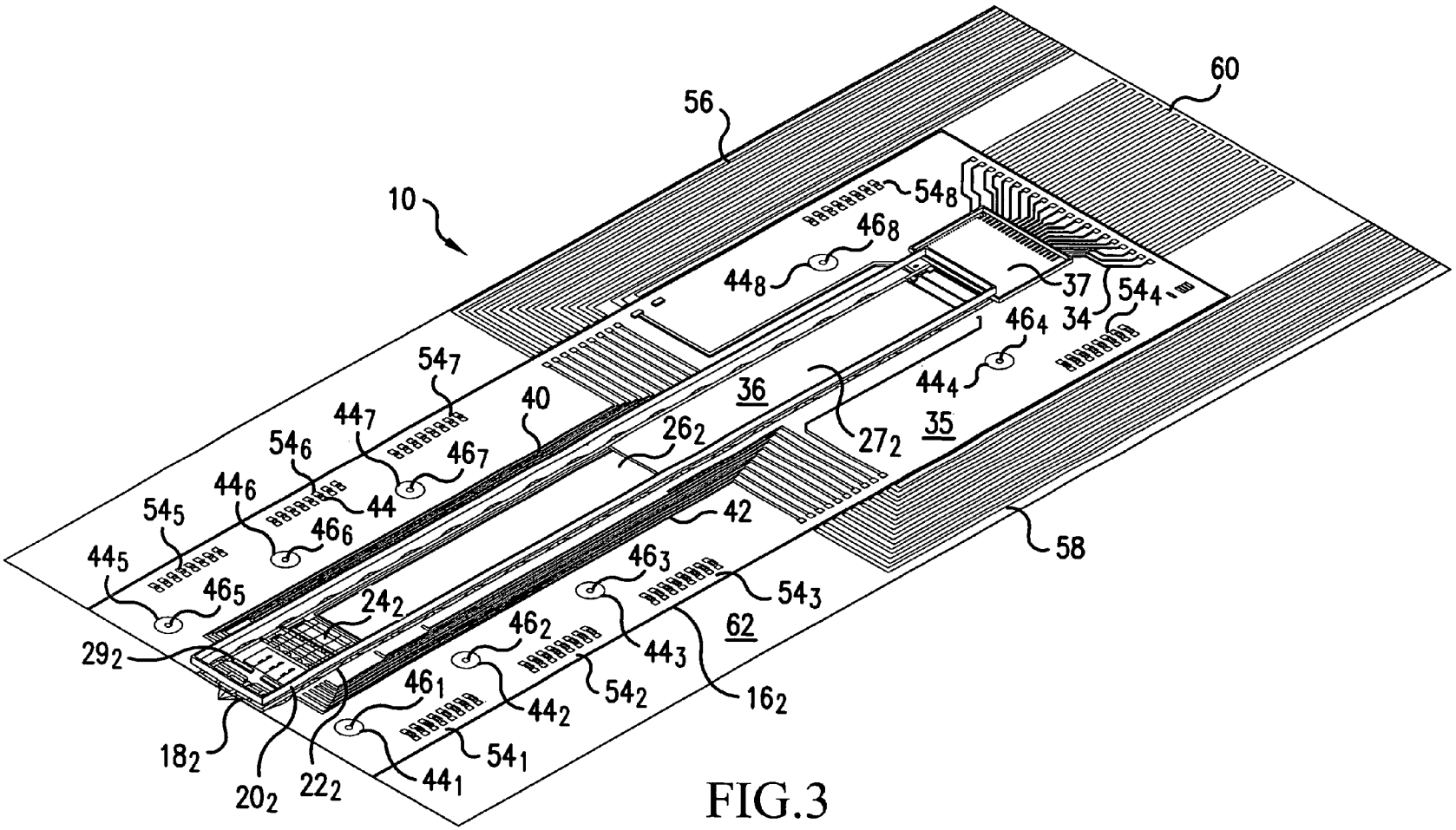
FIG. 3 is a perspective plan view illustrative of the base portion and support member of the subject invention shown in FIG. 2.
Figure 4:
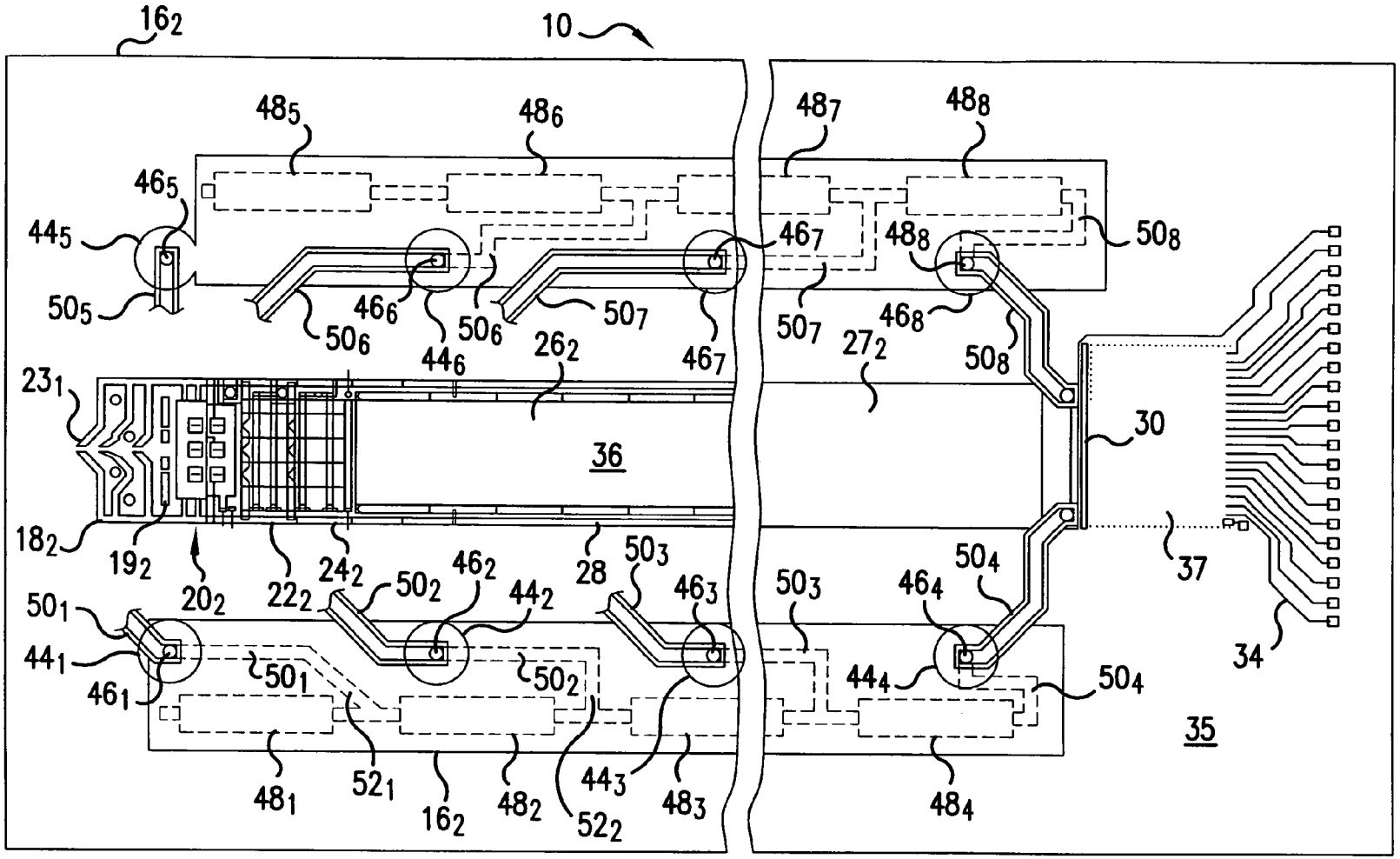
FIG. 4 is a fragmented top planar view further illustrative of the base portion of the subject invention shown in FIG. 3; and, FIG. 5 is a partial perspective view illustrative of an enlarged portion of the front end section of the subject invention shown in FIG. 2.

The mass spectrometer apparatus 10 of the subject invention is fabricated in an elongated semiconductor chip as shown in FIGS. 2, 3 and 4 and is comprised of a top section 34 and a bottom section 36. The bottom section 36 forms part of a base member 35 shown in FIG. 3. Both sections 34 and 36 each include opposing collimator elements $\mathbf{18}_1$ and $\mathbf{18}_2$, repeller members $\mathbf{19}_1$ and $\mathbf{19}_2$, ionizer chamber elements $\mathbf{20}_1$ and $\mathbf{20}_2$, first and second optics chambers $\mathbf{22}_1$, $\mathbf{22}_2$ and $\mathbf{24}_1$, $\mathbf{24}_2$, upper and lower ion separation chamber portions $\mathbf{26}_1$ and $\mathbf{26}_2$, a pair of drift space regions $\mathbf{27}_1$ and $\mathbf{27}_2$.

Electromagnetic field generation apparatus $\mathbf{28}_1$ and $\mathbf{28}_2$ associated with the ion separation chamber elements $\mathbf{26}_1$ and $\mathbf{26}_2$ and the drift space regions $\mathbf{27}_1$ and $\mathbf{27}_2$ generate orthogonal magnetic and electric fields which operate to separate ions passing through the upper and lower portions $\mathbf{26}_1$ and $\mathbf{26}_2$ of the ionization separation chamber and drift space portions $\mathbf{27}_1$ and $\mathbf{27}_2$ and strike the detector array 30 which are comprised of multiple detector elements. The readout chip 32 converts detected analog signals to digital form which is then fed via a set of signal leads 34 to a digital signal processor 36 which generates output signals for a readout in the form of a visible display 38.

Referring now to FIGS. 3 and 4, shown thereat is the lower half portion $\mathbf{16}_2$ of the mass spectrometer apparatus 10 and corresponds to the structure shown in FIG. 2, but now there is additionally shown in FIG. 3 two sets of electrical signal leads 40 and 42 along with eight solder bumps $\mathbf{44}_1$, $\mathbf{44}_2$ . . . $\mathbf{44}_8$ surrounding respective apertures $\mathbf{46}_1$, $\mathbf{46}_2$ . . . $\mathbf{46}_8$ which are connected to eight individual evacuation pumps $\mathbf{48}_1$, $\mathbf{48}_2$ . . . $\mathbf{48}_8$ shown in FIG. 4, via pneumatic pipe members $\mathbf{50}_1$, $\mathbf{50}_2$ . . . $\mathbf{50}_8$ and $\mathbf{52}_1$, $\mathbf{52}_2$ . . . $\mathbf{52}_8$. Electrical power is provided to the individual pumps $\mathbf{48}_1$, $\mathbf{48}_2$ . . . $\mathbf{48}_8$ by way of connector elements $\mathbf{54}_1$, $\mathbf{54}_2$ . . . $\mathbf{54}_8$. Further, as shown in FIG. 3, three sets of electrical signal leads 56, 58 and 60 are located on a support member 62 for connection of the spectrometer 10 to external apparatus, not shown.

Figure 5:
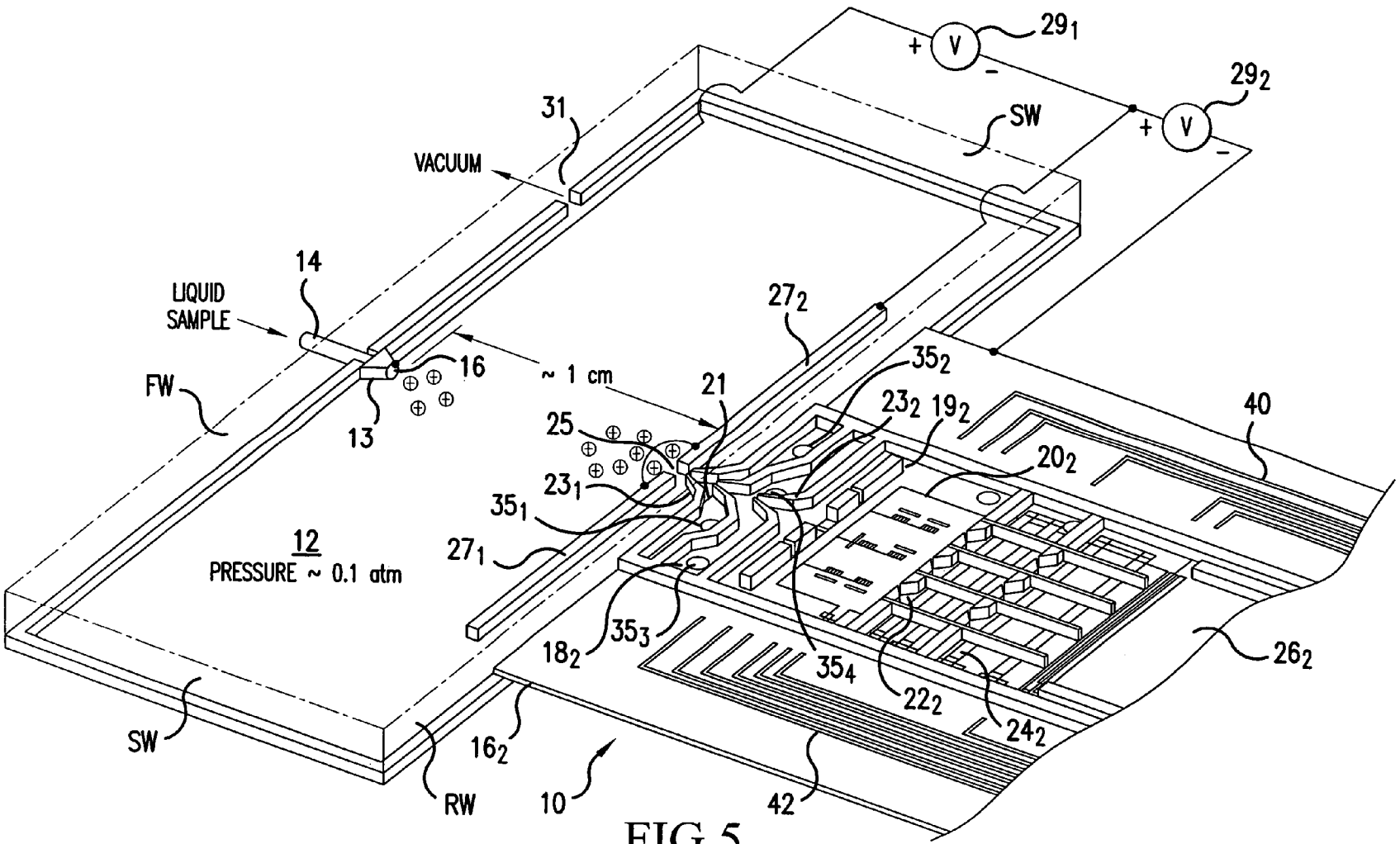

Referring now to FIG. 5, shown thereat are the structural details of the front end portion of the bottom section $\mathbf{16}_2$ of the mass spectrometer apparatus 10 and is intended to further illustrate the structure of the collimator section $\mathbf{18}_2$ and the details of the electrospray-ionizer chamber 12. In FIG. 5, the electrospray-ionizer chamber 12 comprises a generally rectangular housing having an input port 13 to accommodate a commercially available nanoelectrospray member 14 having a tip 16 located in a front wall FW for injecting a liquid input sample into the chamber 12. A nanoelectrospray output port 21 is located in a rear wall RW of the chamber 12 so as to mate with the collimator section $\mathbf{18}_2$ of the bottom section 36 of the spectrometer 10. The collimator section $\mathbf{18}_2$ is comprised of three mutually aligned outwardly diverging pairs of collimator elements $\mathbf{23}_1$, $\mathbf{23}_2$, and $\mathbf{23}_3$ terminating in a tip pointing to the output port 21 of the electrospray-ionizer chamber 12 so as to allow ions formed of the liquid sample to enter to the collimator portion $\mathbf{18}_2$ of the mass spectrometer apparatus 10. The foremost pair of collimator elements $\mathbf{23}_1$ project into the output port 21 of the electrospray-ionizer chamber 12 toward an opening 25 between a pair of elongated bar members $\mathbf{27}_1$ and $\mathbf{27}_2$ which are spaced approximately 1 centimeter away from the tip 15 of the electrospray sample input member. A voltage from a voltage source $\mathbf{29}_1$ of two voltage sources $\mathbf{29}_1$ and $\mathbf{29}_2$ is applied between the elongated bar members $\mathbf{27}_1$ and $\mathbf{27}_2$ and the nanoelectrospray member 14 and is poled so as to attract ions having a positive polarity to the opening 25 and then into the collimator portion $\mathbf{18}_2$. The second voltage source $\mathbf{29}_2$ is shown connected between the bar members $\mathbf{27}_1$ and $\mathbf{27}_2$ and the lower section 36 of the spectrometer 10. Accordingly, positive ions travel into the collimator section $\mathbf{18}_2$ where they pass into a second ionizer chamber $\mathbf{20}_2$ and the lower portions $\mathbf{22}_2$ and $\mathbf{24}_2$ of the ion optics chambers 22 and 24 and then into the ion separation chamber 26, the lower portion thereof being shown by reference numeral $\mathbf{26}_2$.

Although small molecules of a liquid sample will be vaporized in the interior of the electrospray-ionizer chamber 12, this operation can be carried out in a pressure regime that can be as high as atmospheric pressure but is preferably carried out in a vacuum. To this end, a vacuum port 31 is shown located in the front wall FW of the chamber 12 to accommodate a vacuum pump shown, for example in FIG. 1 by reference numeral 33.

Furthermore a differential vacuum pumping scheme is provided in the collimator section $\mathbf{18}_2$ of the spectrometer 10 and as such includes four small circular openings $\mathbf{35}_1$, $\mathbf{35}_2$, $\mathbf{35}_3$ and $\mathbf{35}_4$ which are respectively coupled, for example, to pumps $\mathbf{48}_1$, $\mathbf{48}_2$, $\mathbf{48}_5$ and $\mathbf{48}_6$ as shown in FIG. 4. Additional stages of vacuum pumping are also provided by the pumps $48_3$, $48_4$, $48_7$ and $48_8$ to provide proper vacuum levels in the nanoelectrospray and mass separation regions of the spectrometer apparatus 10. The differentially pumped front end allows the apparatus to sample a higher pressure regime and analyze ions formed at a lower pressure.

Thus what has been shown described is a structure for use in a miniature mass spectrometer in sampling biological small molecule ions that are vaporized and ionized through the use of nanoelectrospray in a vacuum.

The foregoing detailed description merely illustrates the principles of the invention. It will be appreciated that those skilled in the art will be able to devise various arrangements which, although not explicitly described or shown herein, embody the principles of the invention and are thus within its spirit and scope.

What is claimed is:

1. A apparatus for analyzing biological small molecules of a liquid sample, comprising:

an evacuated liquid sample input chamber including apparatus for vaporizing and ionizing a liquid sample being fed into the chamber;

mass spectrometer apparatus fabricated on a semiconductor chip connected to the input chamber and having an input port for receiving ionized vapor of the liquid sample from the input chamber, and wherein the spectrometer apparatus includes, a collimation chamber having a vapor collimation sub-assembly connected to the liquid sample input chamber via an output port thereof and having at least one vacuum pumping aperture and vacuum pump for evacuating and drawing said ionized vapor from the evacuated chamber into the collimation chamber;

a repeller sub-assembly located adjacent the vapor collimation sub-assembly of the collimation chamber;

an ionizer sub-assembly located adjacent the repeller member for further ionizing the ionized vapor;

an ion optics chamber located adjacent the ionizer sub-assembly;

at least one evacuated ion filter and separation chamber located adjacent the ion optics chamber and including means for generating an electromagnetic field therein for separating ions therein by their respective mass/charge ratio; and a detector array for detecting ions separated in the mass filter and ion separation chamber and located a predetermined distance therefrom by an intermediate drift space region.

2. The apparatus according to claim 1 wherein said input chamber includes electrospray apparatus for feeding a liquid sample into the input chamber.

3. The apparatus according to claim 2 wherein said electrospray apparatus comprises nanoelectrospray apparatus.

4. The apparatus according to claim 3 wherein the nanoelectrospray apparatus includes a nanoelectrospray tip inserted into the liquid sample input chamber for feeding the liquid sample into the input chamber.

5. The apparatus according to claim 4 wherein the liquid sample input chamber includes an electrode assembly located adjacent the output port of the input chamber and circuitry for applying an electrical potential thereto for attracting ions to said output port.

6. The apparatus according to claim 5 wherein said electrode assembly comprises a pair of elements having an opening therebetween located adjacent said output port.

7. The apparatus according to claim 6 wherein said pair of elements comprises a pair of mutually aligned elongated electrode members.

8. The apparatus according to claim 6 wherein the collimation chamber includes a plurality of mutually aligned collimator members located adjacent an input port and upstream of said repeller member.

9. The apparatus according to claim 8 wherein each of said collimator members are comprised of pairs of outwardly extending collimator elements having an opening therebetween and terminating in a tip facing the input port.

10. The apparatus according to claim 9 wherein the tip of a first pair of outwardly extending elements is inserted in the output port of the liquid sample input chamber.

11. The apparatus according to claim 10 wherein said collimator chamber includes a plurality of vacuum pump inlets selectively spaced adjacent the pairs of collimator elements for providing differential vacuum pumping therein.

12. The apparatus according to claim 11 wherein said plurality of collimator elements comprises at least three collimator members and said plurality of vacuum pump inlets comprises at least four vacuum pump inlets.

13. The apparatus according to claim 1 wherein said collimation chamber includes a plurality of vacuum pump inlets and respective vacuum pumps connected thereto for providing differential pumping of the ionized vapor in the collimation chamber.

14. The apparatus according to claim 13 and additionally including another plurality of vacuum pump inlets and respective vacuum pumps selectively located in the mass spectrometer system downstream of the collimation chamber.

15. The apparatus according to claim 1 and wherein the repeller assembly includes a set of elongated electrically conductive members including an opening for the passage of the vaporized input sample from the collimation chamber into the ionization chamber.

16. The apparatus according to claim 1 wherein the mass spectrometer assembly is comprised of two body members jointed together along a length dimension thereof and having an elongated cavity therein in which is located components of the mass spectrometer assembly.

17. The apparatus according to claim 1 wherein means for generating the electromagnetic field includes means for generating orthogonal magnetic and electric fields in the region of the ion filter and separation chamber and the drift space region.

* * * * *